US011352722B2

(12) United States Patent
Eklind et al.

(10) Patent No.: US 11,352,722 B2
(45) Date of Patent: Jun. 7, 2022

(54) SYSTEM FOR IN-LINE TREATMENT OF THREAD

(71) Applicant: Coloreel Group AB, Jönköping (SE)

(72) Inventors: Martin Eklind, Jönköping (SE); Joakim Staberg, Jönköping (SE)

(73) Assignee: Coloreel Group AB, Jonkoping (SE)

( * ) Notice: Subject to any disclaimer, the term of this patent is extended or adjusted under 35 U.S.C. 154(b) by 98 days.

(21) Appl. No.: 16/302,358

(22) PCT Filed: May 17, 2017

(86) PCT No.: PCT/SE2017/050516
§ 371 (c)(1),
(2) Date: Nov. 16, 2018

(87) PCT Pub. No.: WO2017/200473
PCT Pub. Date: Nov. 23, 2017

(65) Prior Publication Data

US 2019/0276956 A1 Sep. 12, 2019

(30) Foreign Application Priority Data

May 17, 2016 (SE) ..... 1650668-5

(51) Int. Cl.
*D03J 1/04* (2006.01)
*B05B 13/00* (2006.01)
(Continued)

(52) U.S. Cl.
CPC ..... *D03J 1/04* (2013.01); *B05B 1/00* (2013.01); *B05B 13/00* (2013.01); *B41J 3/4078* (2013.01);
(Continued)

(58) Field of Classification Search
CPC ..... B05C 5/0241; B05B 13/0207
See application file for complete search history.

(56) References Cited

U.S. PATENT DOCUMENTS 4,501,588 A 2/1985 Suzuki et al.
5,624,494 A 4/1997 Schmolke et al.
(Continued)

FOREIGN PATENT DOCUMENTS

CL 2018002535 A1 12/2018
CN 2490176 5/2002
(Continued)

OTHER PUBLICATIONS

International Search Report issued in corresponding PCT Application No. PCT/SE2017/050516, dated Jun. 22, 2017, pp. 1-4.
(Continued)

*Primary Examiner* — Binu Thomas
(74) *Attorney, Agent, or Firm* — Murtha Cullina LLP

(57) ABSTRACT

A system for in-line treatment of at least one thread is provided. The system is configured to be used with a thread consuming device and comprises a treatment unit having a plurality of nozzles arranged at different positions relative the at least one thread, said at least one thread being in motion in use, each nozzle being configured to dispense one or more coating substances onto the at least one thread when activated; and at least one thread engagement device configured to rotate the at least one thread along its longitudinal axis as the at least one thread moves through said treatment unit.

10 Claims, 5 Drawing Sheets

(51) Int. Cl.

| | |
|---|---|
| ***B41J 3/407*** | (2006.01) |
| ***D06P 5/30*** | (2006.01) |
| ***D06B 11/00*** | (2006.01) |
| ***B05B 1/00*** | (2006.01) |
| *D05B 67/00* | (2006.01) |
| *D05C 11/24* | (2006.01) |

(52) U.S. Cl.
CPC ..... *D06B 11/0003* (2013.01); *D06B 11/0023* (2013.01); *D06B 11/0036* (2013.01); *D05B 67/00* (2013.01); *D05C 11/24* (2013.01); *D06P 5/30* (2013.01)

(56) References Cited

U.S. PATENT DOCUMENTS

| | | | | |
|---|---|---|---|---|
| 5,745,628 | A | 4/1998 | Benzel et al. | |
| 5,896,634 | A | 4/1999 | Brodowski et al. | |
| 6,189,989 | B1 * | 2/2001 | Hirabayashi | B41J 3/407 347/106 |
| 2004/0244441 | A1 | 12/2004 | Shaw et al. | |
| 2005/0257737 | A1 * | 11/2005 | Leonard | B05C 11/021 118/110 |
| 2006/0100736 | A1 | 5/2006 | Kamata et al. | |
| 2008/0098581 | A1 * | 5/2008 | Massotte | D02G 1/002 28/171 |
| 2014/0349034 | A1 * | 11/2014 | Staberg | D05C 11/24 118/620 |

FOREIGN PATENT DOCUMENTS

| | | | | | |
|---|---|---|---|---|---|
| CN | 1430687 | A | | 7/2003 | |
| CN | 1572950 | A | | 2/2005 | |
| CN | 1682323 | A | | 10/2005 | |
| CN | 101173415 | A | | 5/2008 | |
| CN | 201439265 | U | | 4/2010 | |
| CN | 103930608 | A | | 7/2014 | |
| EA | 201891920 | A1 | | 4/2019 | |
| EP | 1548575 | A2 | | 6/2005 | |
| EP | 1548757 | A1 | | 6/2005 | |
| JP | 06-305129 | A | | 11/1994 | |
| JP | H0742085 | A | | 2/1995 | |
| JP | 0770952 | A | | 3/1995 | |
| JP | 11207963 | A | | 8/1999 | |
| JP | 2002200381 | A | | 7/2002 | |
| JP | 2003342867 | | | 12/2003 | |
| JP | 2003342867 | A | * | 12/2003 | D06B 11/0023 |
| JP | 20033412867 | A | | 12/2003 | |
| JP | 2005518920 | A | | 6/2005 | |
| JP | 2006299462 | A | | 11/2006 | |
| JP | 2014532121 | A | | 12/2014 | |
| KR | 1980-0000691 | | | 7/1980 | |
| KR | 100985471 | B1 | | 10/2010 | |
| KR | 10-2012-0119912 | A | | 10/2012 | |
| WO | 0012804 | | | 3/2000 | |
| WO | 32063094 | A1 | | 8/2002 | |
| WO | 33072266 | A1 | | 9/2003 | |
| WO | 2013039447 | A1 | | 3/2013 | |
| WO | 2017155451 | A1 | | 9/2017 | |

OTHER PUBLICATIONS

Office Action from corresponding MX Application No. MX/a/2018/010325, dated Apr. 14, 2021.
Office Action from corresponding Korean Application No. 10-2018-7036567, dated Feb. 4, 2021.
Office Action from corresponding Japanese Application No. 2018-560650, dated Apr. 6, 2021.
Office Action from corresponding Brazilian Patent Application No. BR112018067863-5, dated Apr. 29, 2021.

* cited by examiner

SYSTEM FOR IN-LINE TREATMENT OF THREAD

CROSS-REFERENCE TO RELATED APPLICATIONS

This application is a national stage application of and claims priority to, PCT/SE2017/050516, filed on May 17, 2017, which claims priority to Swedish application no. 1650668-5, filed on May 17, 2016. The entireties of both applications are incorporated by reference herein.

TECHNICAL FIELD

The present invention relates to a system for in-line treatment of thread for use with a thread consuming device.

BACKGROUND

It has been suggested to provide thread consuming devices, such as embroidery machines or the like, with in-line apparatuses designed to provide the thread with a certain treatment. Such in-line apparatuses could e.g. be used to colour the thread, whereby multiple colour nozzles could replace the current use of multiple pre-coloured threads when producing multi-coloured patterns.

When a nozzle is arranged to colour a thread passing by the droplet will hit the thread at a specific circumferential position. Due to the specific properties of the thread and of the colouring substance it cannot be assured that the colour substance will bleed around the entire circumference of the thread. Hence, an uneven colouring is achieved.

In view of this there is a need for an improved system for in-line treatment of thread, addressing the disadvantages mentioned above.

SUMMARY

According to a first aspect a system for in-line treatment of at least one thread is provided. The system is configured to be used with a thread consuming device and comprises a treatment unit having a plurality of nozzles arranged at different positions relative the at least one thread, said at least one thread being in motion in use, each nozzle being configured to dispense one or more coating substances onto the at least one thread when activated; and at least one thread engagement device configured to rotate the at least one thread along its longitudinal axis as the at least one thread moves through said treatment unit.

One of said at least one thread engagement devices may be arranged on a downstream side of the treatment unit along the travel direction of the at least one thread.

Said at least one thread engagement device may be configured to apply a torque to said at least one thread in order to initiate a rotation of the at least one thread.

Said engagement device may comprise an engagement surface which, when in contact with said at least one thread, provides a rotation of said at least one thread.

In an embodiment said at least one thread engagement device is a guiding member.

One of said at least one thread engagement device may be moveable in order to control the rotation of the at least one thread along its longitudinal axis.

Said at least one thread engagement device may be one or more tubular members through which the at least one thread is guided.

In an embodiment one tubular member is arranged on a downstream side of said treatment unit, and/or one tubular member is arranged on an upstream side of said treatment unit.

The inner diameter of said tubular member may be selected such that the inner walls of said tubular member will apply a friction force to said at least one thread.

Said tubular member may be rotatable along its longitudinal axis.

In an embodiment said at least one thread engagement device comprises a rotating engagement member having an outer surface on which the at least one thread is guided for providing a rotation.

The system may further comprise at least one thread guiding member arranged downstream and/or upstream the at least one thread engagement device.

The nozzles may be inkjet nozzles, and the coating substance may be a colouring substance.

According to a second aspect a thread consuming device is provided. The device comprises a thread consuming unit and a system according to the first aspect.

The thread consuming unit may be an embroidery unit, a sewing unit, a knitting unit, or a weaving unit.

According to a third aspect, a method for providing a system for in-line treatment of thread is provided. The method comprises providing a treatment unit having a plurality of nozzles arranged at different longitudinal positions along the thread, each nozzle being configured to dispense a coating substance onto the thread when activated; and providing a thread engagement device configured to rotate the thread along its longitudinal axis as the thread moves through said treatment unit.

According to a fourth aspect, a method for providing treatment to at least one thread prior to being fed to a thread consuming device is provided. The method comprises feeding the at least one thread such that it engages with at least one thread engagement device whereby the at least one thread causes to rotate along its longitudinal axis, and passing the at least one thread through a treatment unit having a plurality of nozzles arranged at different positions relative the at least one thread, each nozzle being configured to dispense one or more coating substances onto the at least one thread when activated.

Definitions

Thread consumption unit is in this context is any apparatus which in use consumes thread. It may e.g. be an embroidery machine, weaving machine, sewing machine or knitting machine, or any other thread consuming apparatus which may benefit from a surface treatment or coating or any other process involving subjecting the thread to a substance, such as dying.

Treatment is in this context is any process designed to cause a change of the properties of a thread. Such processes include, but are not limited to, colouring, wetting, lubrication, cleaning, etc.

Thread is in this context is a flexible elongate member or substrate, being thin in width and height direction, and having a longitudinal extension being significantly greater than the longitudinal extension of any parts of the system described herein, as well as than its width and height dimensions. Typically, a thread may consist of a plurality of plies being twisted together. The term thread thus includes a yarn, wire, strand, filament, etc. made of various different materials such as glass fibre, wool, cotton, synthetic materials such as polymers, metals, or e.g. a mixture of wool, cotton, polymer, or metal.

Ply is in this context is a flexible member forming part of a thread. A ply typically consists of several filaments being twisted together. For creating a balanced thread, i.e. a thread having no or very little tendency to twist upon itself, the plies and the filaments may in some cases be twisted in opposite direction.

Within this specification, all references to upstream and/or downstream should be interpreted as relative positions during normal operation of the thread consumption device, i.e. when the device is operating to treat an elongated substrate, such as a thread, continuously moving through the device in a normal operating direction. Hence, an upstream component is arranged such that a specific part of the thread passes it before it passes a downstream component.

BRIEF DESCRIPTION OF DRAWINGS

Embodiments of the invention will be described in the following description of the present invention; reference being made to the appended drawings which illustrate non-limiting examples of how the inventive concept can be reduced into practice.

DETAILED DESCRIPTION

An idea of the present invention is to provide a system and method for distributing a coating substance onto a thread in a controlled manner, for use in association with a thread consumption unit to form a thread consumption device. The thread consumption unit may e.g. be an embroidery machine, weaving machine, sewing machine or knitting machine. More particularly, a general object is to allow for a precise dispensing onto the thread at defined circumferential positions around the thread which is advantageous as such precise dispensing will allow for a very accurate positioning of the coating substance onto the thread. For example, it will be possible to obtain specific colouring patterns onto the thread.

Figure 1:
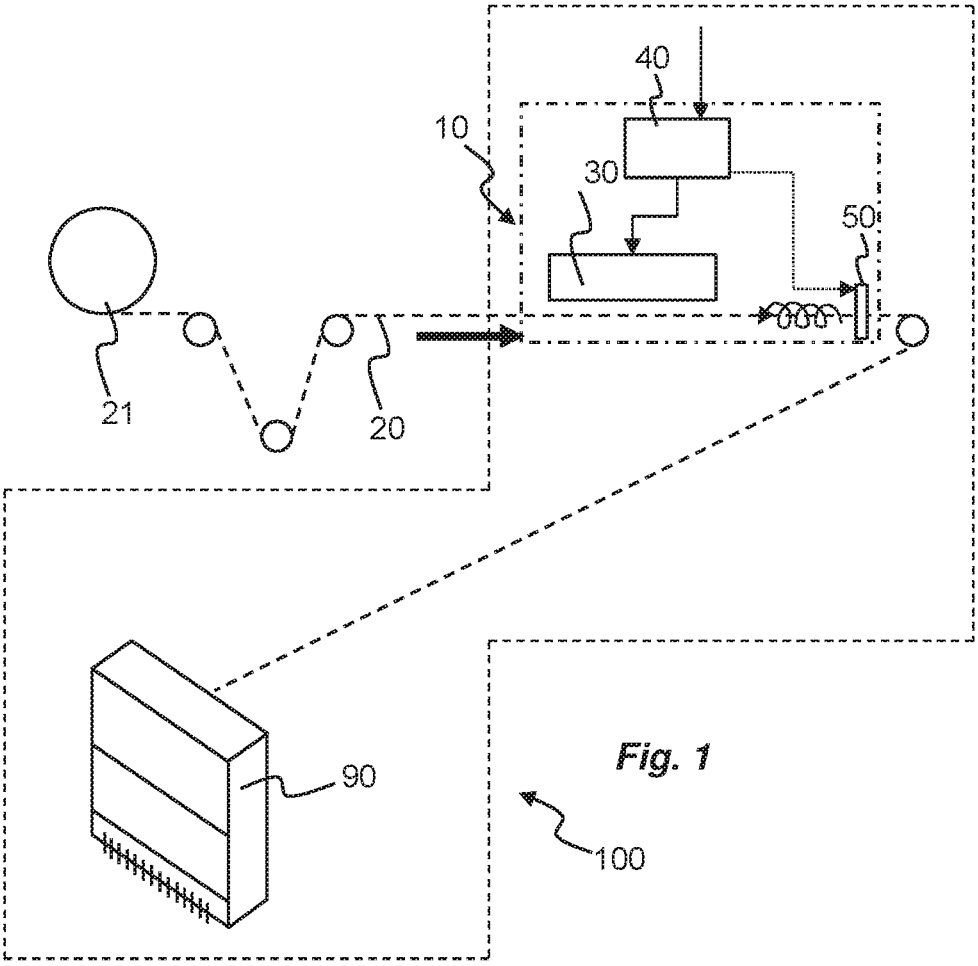
FIG. 1 is a schematic view of a thread consumption device according to an embodiment.

A system 10 for in-line treatment of thread 20 for use with a thread consumption device 100, including a thread consumption unit 90 such as an embroidery machine, is schematically shown in FIG. 1. The thread 20 is fed from a thread supply 21, passes through the system 10 for in-line treatment of the thread 20, and is fed to the thread consumption unit 90.

The system 10 comprises a treatment unit 30 being configured to dispense a coating substance, such as ink, onto the thread 20 when the treatment unit 30 is activated. A control unit 40 is connected to the treatment unit 30 for controlling the operation of the treatment unit 30 as will be further described below. A thread engagement device 50 is provided downstream the treatment unit 10 for causing a rotation of the thread 20 such that the thread 20 will rotate as it passes the treatment unit 30 as indicated by the curved arrow in FIG. 1.

Due to the fact that the thread 20 rotates while passing the treatment unit 30 it is possible to provide a more even treatment of the thread 20 around its periphery, which thereby increases the quality of the treatment. The solution of arranging a thread rotating unit, i.e. the thread engagement device 50, downstream the treatment unit 30 may be particularly advantageous for in-line colouring systems utilizing inkjet technology, i.e. a system where the treatment unit 30 comprises several inkjet nozzles. In such application the inkjet nozzles may be aligned in a direction towards the thread 20 and the thread 20 may be coloured at several positions along its longitudinal extension. As the thread 20 rotates the dispensed droplets will hit the thread 20 at specific circumferential positions whereby a more even colouring will be provided.

The thread engagement device 50 could be realized in many different ways, e.g. as a static (or fixed) structure, or as a dynamic and controllable structure. In the following some of these alternatives will be discussed in more detail.

Common for all examples is that the thread engagement device 50 ensures a rotation of the thread 20, i.e. the thread 20 rotates while passing the treatment unit 30.

Figure 2:
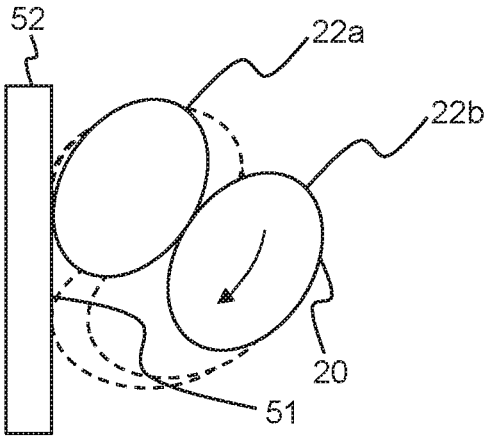
FIG. 2 is a cross-sectional view of a thread engagement device of a system for in-line treatment of thread according to an embodiment.

In one embodiment, as is shown in FIG. 2, the thread engagement device 50 is a guiding member 52 having an engagement surface 51. This kind of thread engagement device is particularly advantageous for threads 20 having an asymmetric cross-section. As is shown in FIG. 2 the thread 20 is formed by two plies 22*a*, 22*b* being twisted together. Hence, each ply 22*a*, 22*b* follows a helical pattern extending in their longitudinal direction.

When the thread 20 comes into contact with the guiding member 52, which is positioned such that the thread 20 is urged to be guided by it, the guiding member 52 will apply a force to the engagement surface 51 due to the thread tension. This force will urge the thread 20 to rotate until there is equilibrium between the torque resulting from the applied force, the intrinsic twist of the thread 20, and the downstream movement of the thread 20. More specifically the applied torque is a result by the friction at the engagement surface 51, the asymmetrical configuration of the thread 20, and the thread movement. Due to the friction the thread 20 will be urged to rotate so that the contact area between the thread 20 and the engagement surface 51 is maximized. This is shown by the dashed lines in FIG. 2, indicating the rotational behaviour of the thread 20. In some cases the elasticity of the thread 20 will counteract the applied rotation, however also in these cases it has been shown that a net rotation is achieved. In particular the net rotation has been shown to be based on the thread tension, the friction, and the elasticity of the thread 20.

Hence, in its most simple form the thread engagement device 50 is a static guiding member 52 having an engagement surface 51 contacting the thread 20 as the thread 20 passes by the engagement surface 51. It would however be possible to add a controllable functionality to the thread engagement device 50, e.g. by arranging the guiding member 52 on a movable stage (not shown) whereby the position of the guiding member 52 will affect the force applied to the thread 20 and thus controlling the rotation of the thread 20 under the thread treatment unit 30.

Figure 3:
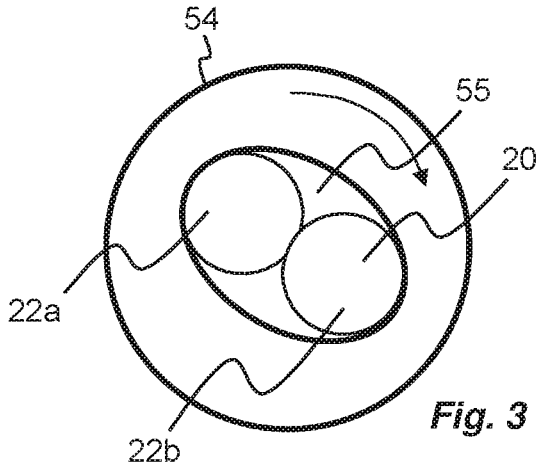
FIG. 3 is a cross-sectional view of a thread engagement device of a system for in-line treatment of thread according to another embodiment.

In FIG. 3 another example of a thread engagement device 50 is shown. As will be explained below the thread engagement device 50 may be positioned either upstream or downstream of the treatment unit 30. In some embodiments a first thread engagement device 50 is positioned upstream the treatment unit 30, and a second thread engagement device 50 is positioned downstream the treatment unit 30. Here the thread engagement device 50 is a moveable tubular member 54 through which the thread 20 is guided. The tubular member 54 has a cylindrical shape and an inner cavity 55. The inner cavity 55, forming the thread guiding space, is preferably non-circular so it will prevent an asymmetric thread 20 from rotating relative the tubular member 54. The thread 20 is thus rotationally secured relative the tubular member 54. Preferably the tubular member 54 is very thin in the longitudinal direction of the thread 20 so that it could be used for threads 20 having different twist, i.e. for threads 20 having different helical pattern of the plies 22*a*, 22*b* without damaging the thread 20. For the same reason the tubular member 54 may be elastic, which also provides the advantage of improved contact with the thread 20.

The tubular member 54 is connected to a rotational driver (not shown) which is capable of rotating the tubular member 54 along its longitudinal axis. When activated the thread 20 will consequently rotate with the tubular member 54, whereby an upstream rotation of the thread 20 is accomplished. For this to happen, the inner diameter of the tubular member 54 is selected such that the inner walls of the tubular member 54 apply a friction force to the thread 20.

For the embodiments described with reference to FIGS. 2 and 3 it should be realized that the thread 20 could have any number of plies 22*a*, 22*b* as long as the cross-section of the thread 20 is asymmetric. However, as mentioned above the tubular member 54 may be somewhat elastic, which means that engagement with threads 20 having a circular cross-section is also possible. The same may be achieved also for a non-elastic tubular member, but for which the dimensions are so well-fitted to the dimensions of the thread 20.

Figure 4:
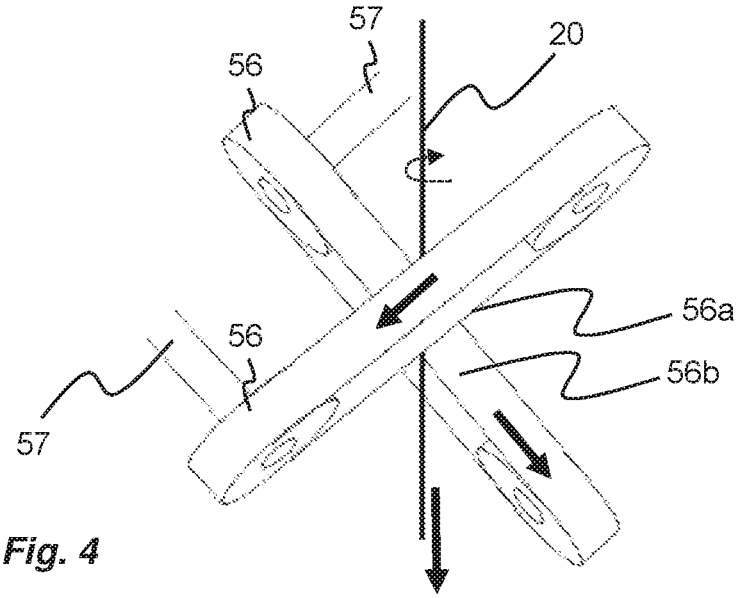
FIG. 4 is an isometric view of a thread engagement device of a system for in-line treatment of thread according to another embodiment.

In FIG. 4 a yet further embodiment of a thread engagement device 50 is shown. In this example the thread engagement device 50 has two rotating engagement members 56. Each rotating member 56 includes an endless belt 56*a*, 56*b* being driven by a rotational shaft 57. Each belt 56*a*, 56*b* forms an outer surface on which the at least one thread 20 is guided; in this example the thread 20 is fed at the interface between two adjacent belts 56*a*, 56*b*. As the thread 20 passes through this interface the belts 56*a*, 56*b* will urge the thread 20 to rotate. It should be noted that the embodiment shown in FIG. 4 does not require an asymmetric thread 20, and the thread engagement device 50 of this embodiment has proven not to add any substantial increase of friction in the associated in-line treatment system.

Again referring to FIG. 1 there is only one thread engagement device 50 provided. However, as will be described in the following several thread engagement devices 50 could be used in combination with a treatment unit 30. For such embodiments it is not required that the thread engagement devices 50 are identical, but different types of thread engagement devices 50 could be used in combination as long as each thread engagement 50 contributes to a forced rotation of thread 20, and as long as at least one thread engagement device 50 is optionally arranged downstream the treatment unit 30. Hence additional thread engagement devices 50 could be used not only to increase the total rotation of the thread 20, but also for other important functions such as thread guiding. A thread engagement device 50 could for this purpose be arranged immediately upstream the treatment unit 30 for aligning the thread 20 with the dispensing means of the treatment unit 30. An additional thread engagement device 50 is consequently arranged downstream the treatment unit 30 for ensuring the desired rotation of the thread 20 when the thread 20 passes the treatment unit 30. This is due to the fact that the maximum rotation is occurring immediately upstream of the thread engagement device 50, at least for the thread engagement device 50 shown in FIG. 2.

So far the system 10 comprising the thread engagement device(s) 50 has only been described to engage with a single thread 20. However, it has been shown that the proposed system can also be used for a plurality of threads 20. These threads 20 may e.g. be twisted to form a thread bundle, whereby the treatment unit 30 ensures an even colouring around the circumference of the entire thread bundle. The multiple threads may be separated further downstream, or remain in a bundled state for later processes.

Optionally the threads may be fed to the thread engagement device(s) 50 in a separated state, whereby the threads are running more or less in parallel through the system. When the threads are in contact with the thread engagement device a rotation occur, not only for each thread per se but also for the entire bundle of threads. Hence, the threads will twist around each other immediately upstream the thread engagement device 50, but again separated downstream the thread engagement device 50. This phenomenon applies e.g. for the thread engagement devices shown in FIGS. 3 and 4. This phenomenon can thus be utilized for colouring multiple threads at the same time, while keeping the threads separated before and after they pass the treatment unit 30.

Figure 5:
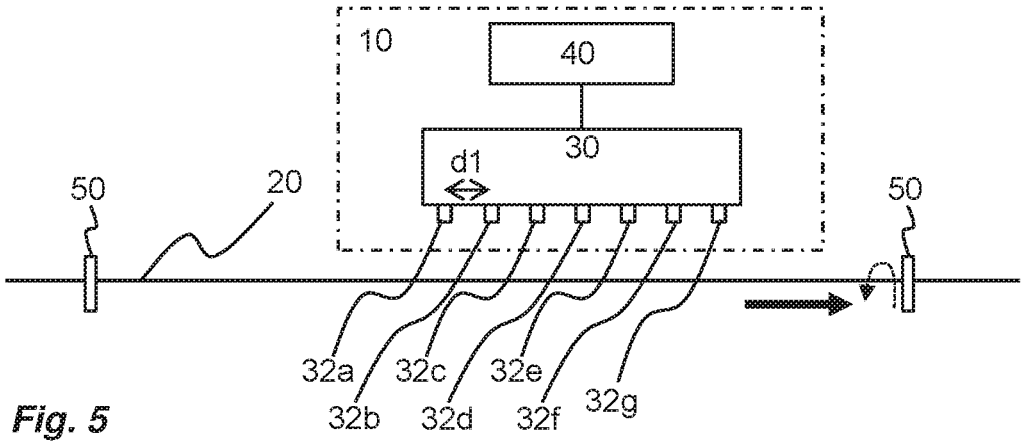
FIG. 5 shows a schematic view of a system according to an embodiment.

Now turning to FIG. 5 an embodiment of a system 10 for in-line treatment of a thread is shown in more detail. The treatment unit 30 has a plurality of nozzles 32*a-g* arranged at different longitudinal positions along the thread 20 which passes by the treatment unit 30 during use. The direction of movement of the thread in use is indicated by the solid arrow in FIG. 5. Each nozzle 32*a-g* is arranged to dispense a coating substance, such as ink, onto the thread 20 when the nozzle is activated. The system 10 further comprises a control unit 40 arranged to activate at least two of the nozzles 32*a-g* to dispense the coating substance such that the coating substance is absorbed by the thread 20 at different circumferential positions of the thread 20 when the thread 20 rotates about its longitudinal axis due to the thread engagement device 50, optionally arranged downstream the treatment unit 30. The relative position of two adjacently dispensed droplets of coating substance may be selected such that the droplets will at least to some extent overlap, i.e. a portion of the circumferential area of the thread 20 will be covered by two adjacent droplets. The rotation of the thread 20 is illustrated by the curved dashed arrow in FIG. 5.

For a colouring operation the control unit 40 receives one or more input signals specifying the desired colour and/or colouring effect. The colour input preferably includes information regarding the exact colour, as well as the longitudinal start and stop positions of the thread 20 for that particular colour. The longitudinal start and stop position could be represented by specific times if the thread speed is determined. The colouring effect input preferably includes pattern information, e.g. if an even colouring is desired. Normally, a homogenous colouring would require coating on different circumferential positions in a close, or even the same, longitudinal range of the thread. On the other hand, a one-sided colouring effect would require coating on a single circumferential position only. Based on the knowledge that the thread 20 has a certain rotation, or twist per length unit, it is possible to precisely dispense the coating substance at different circumferential positions of the thread 20 as the thread 20 passes by the treatment unit 30. By multiplying the twist per length unit with the speed of the thread 20 it is possible to obtain the twist rate, i.e. the rotational or twist angle per second. For example, if the twist per length unit is 360°/cm and the speed of the thread 20 is 2 cm/s, the resulting twist rate is 720°/s, i.e. two 360° revolutions per second. The twist rate may be used to calculate an activation timing required for each nozzle 32*a-g* such that each nozzle 32*a-g* can dispense the coating substance such that the coating substance will hit the thread 20 on a unique circumferential position of the thread 20. It should be appreciated that the twist of the thread 20 relates to a rotation of the thread 20 seen by an observer as the thread is moving in a longitudinal direction. Optionally the thread may also have a native twist, e.g. formed by the helical appearance of a multi-ply thread. When the helically arranged plies pass a fix longitudinal position it will appear as if the thread rotates with reference to the fix longitudinal position. In another embodiment, if the thread comprises only one ply or plies arranged in parallel along the longitudinal extension thereof, the twist or rotation is entirely produced by the thread engagement device 50.

The important factor for achieving a desired treatment of the thread 20 is that the thread 20 rotates when it passes the treatment unit 30, so that the activation of the nozzles 32*a-g* of the treatment unit 30 can be controlled to dispense coating substance at unique circumferential positions of the thread 20 in use. This however also requires a specific distance between the nozzles 32*a-g* in order to achieve the desired treatment effect.

The activation timing can also be based on the knowledge of the longitudinal distance d1 between each of the plurality of nozzles 32*a-g*. For example, it is possible to dispense a coating substance onto a thread 20 at the same longitudinal position and at two chosen circumferential positions, such as 0° and 180°, by knowing the longitudinal distance d1 between the respective nozzles 32*a-g*. For example, if the longitudinal distance between a first and a second nozzle 32*a-g* is 5 mm, giving the example above, it will take 0.25 seconds (5 mm/(2 cm/s)) for a specific position of the thread 20 to move from the first nozzle 32*a-g* to the second nozzle 32*a-g*. In 0.25 seconds the thread 20 has twisted 180° (720°/s*0.25 s). Hence, in this case the activation timing may be calculated such that the first nozzle is activated at time zero, and the second nozzle is activated 0.25 seconds after time zero. The control unit 40 has processing capabilities and may comprise a processor with memory. The control unit 40 may receive input relating to a twist level parameter associated with the level of twist, e.g. twist angle per length unit of the thread 20 and a speed level parameter associated with the speed of the thread 20 passing through the treatment unit 30 in use. The input may be received via another device, e.g. a sensor, graphical user interface (not shown). Alternatively the input may be hard coded into the control unit 40.

The control unit 40 may be further arranged to transmit a control signal to the treatment unit 30. The control signal sent by the control unit to the treatment unit 30 may be an activation signal for activating the nozzles 32*a-g* of the treatment unit 30 according to a dispensing timing scheme selected based on the received twist level parameter and speed level parameter. Hence, the control unit 40 may be arranged to process the twist level parameter and the speed level parameter and determining the dispensing timing scheme. Alternatively, the control signal sent to the treatment unit 30 may comprise information about the twist level parameter and the speed level parameter. The treatment unit 30 receives the control signal from the control unit 40 and dispenses a coating substance to the thread 20 via two or more of the nozzles 32*a-g* according to a dispensing timing scheme selected based on the received twist level parameter and speed level parameter.

Figure 6:
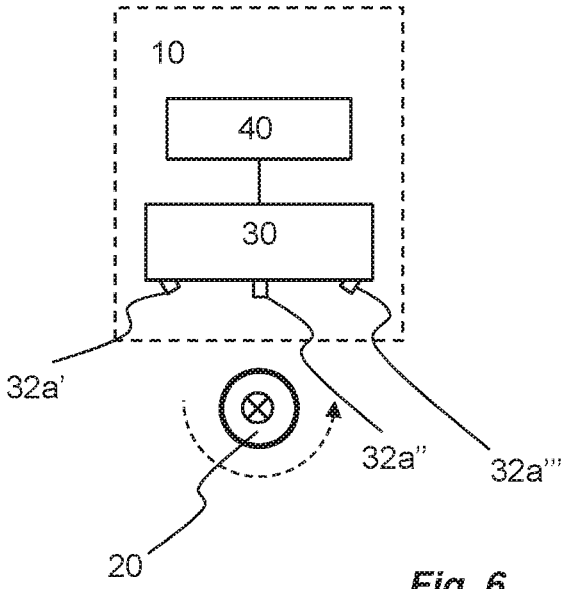
FIG. 6 shows a front view of a system according to an alternate embodiment.

Although seven nozzles 32*a-g* are shown in FIG. 5, the treatment unit 30 need only comprise at least two nozzles such as nozzles 32*a* and 32*b*. However, e.g. a typical inkjet head, which is a suitable component for realizing the invention, comprises hundreds or even thousands of nozzles. Other dispensing technologies may also be used. FIG. 6 illustrates a variation of the system 10 in FIG. 5. In system 10 in FIG. 6 the nozzles 32*a*', 32*a*", 32*a*'" are arranged at different radial positions around the thread 20. The nozzles 32*a*', 32*a*", 32*a*'" may be arranged at a specific longitudinal position, or they may be distributed along the longitudinal direction. While FIG. 5 is a front view of the system 10, FIG. 6 is a side view of the system 10 and the twist of the thread 20 that occurs as the thread 20 moves past the system 10 is shown by the semi-circular dashed arrow. The thread 20 is assumed to move in the direction of the arrow symbol provided in the centre of the thread 20. The system 10 in FIG. 6 also has a treatment unit 30 and a control unit 40 which operate in the same manner as described above in relation to FIGS. 1 and 5. However, the treatment unit 30 and the control unit 40 shown in FIG. 6 are configured to allow for simultaneous activation of the nozzles 32*a*', 32*a*", 32*a*'". A thread engagement device (not shown) may be suitable for the system 10 shown in FIG. 6, especially where a plurality of nozzle sets 32*a*', 32*a*", 32*a*'" are distributed in the longitudinal direction. For such embodiment the longitudinal distance between the nozzle sets can be made very small, as the circumferential distance between the nozzles 32*a*', 32*a*", 32*a*'" in each nozzle set will, in combination with the induced rotation, allow for an even colouring of the thread 20.

Figure 7:
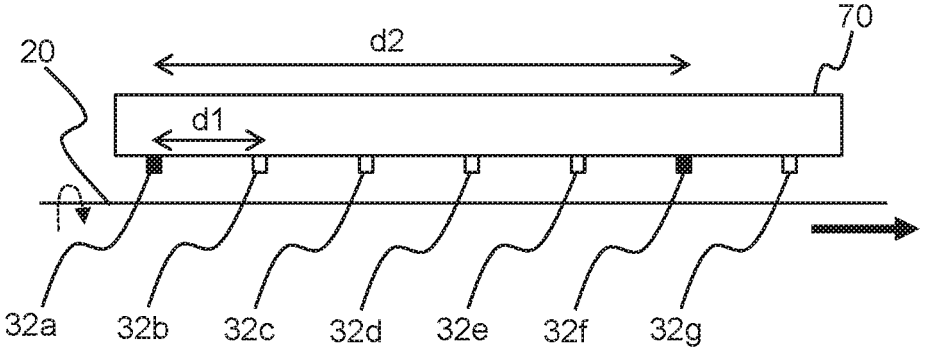
FIG. 7 shows a treatment unit according to an embodiment.

The plurality of nozzles 32*a-g* may be arranged in a static nozzle array 70, e.g. further shown in FIG. 7. Here, the position of the nozzles 32*a-g* and other nozzles (not shown) are fixed on the treatment unit 30. The nozzles 32*a-g* are longitudinally separated by a fix distance d1. Recapturing the example above, if the intention is to dispense coating substance onto the thread 20 at the same longitudinal position thereof at 0° and at 180° it would be possible to calculate a required longitudinal distance d2 by the following formula:)(180°/(twist per length unit), wherein the twist per length unit is (360°/cm) from the example above. Hence, the required longitudinal distance d2 to achieve the required dispensing is 0.5 cm. It should be appreciated that the fix distance d1 between two adjacent nozzles 32*a-g* may be very small such as below 0.05 mm. The control unit (not show in FIG. 7, but connected to the treatment unit 30 in accordance with the description above) may be arranged to identify which nozzles 32*a-g* to activate, based on the calculated required longitudinal distance d2. For example, when the fix distance d1 is 1 mm and the required longitudinal distance d2 is 0.5 cm, i.e. 5 mm, the first nozzle and the sixth nozzle may be identified for activation, since the sixth nozzle is located 5 mm away from the first nozzle. FIG. 7 shows this wherein the first 32*a* and sixth nozzle 32*f* has been indicated. Accordingly, the control unit 40 may activate the nozzles 32*a-g* to dispense a coating substance on a unique circumferential position of the thread 20. A required longitudinal distance d2 may still be calculated by the control unit 40 to identify a suitable nozzle pair, where a second nozzle of the nozzle pair is located at, or as close as possible to, the required longitudinal distance d2 measured from a first nozzle of the nozzle pair. The activation of any required nozzle 32*a-g* may be made using the activation signal and being based on the twist level parameter discussed above, and/or based on the desired result. The examples above illustrate the possibility of dispensing at two specific circumferential positions, optionally at the same longitudinal position of the thread 20 as long as the thread 20 rotates when passing the treatment unit 30. Instead, in some embodiments it is more preferred to dispense the coating substance at regular longitudinal intervals along the thread 20 but from different circumferential positions. However, for colours requiring a high saturation level it may be desired to dispense several droplets at the same longitudinal position. By being able to controllably dispensing the coating substance at different circumferential positions of the thread 20 it is possible to provide the thread 20 with novel coating features, such as homogeneous solid colour, solid colour with mixed shades, gradients, shades, simulated reflections, helical colouring pattern, one-side only colouring, etc. The length of the nozzle array may preferably be at least as long as the distance it takes for the thread 20 to rotate one 180° revolution around itself, and more preferably at least as long as the distance it takes for the thread 20 to rotate a 360° revolution around itself.

However, it should be noted that in some embodiments it may be advantageous to allow the thread 20 to rotate more than one revolution between the longitudinal ends of the nozzle array 70, i.e. between the first and last nozzle of the array 70. This could be particularly advantageous when more than two nozzles 32*a-g* are arranged in the treatment unit 30. By providing an induced rotation to make the thread 20 rotate several revolutions between the first nozzle 32*a* and the last nozzle 32*g* an even coating that evenly covers the outer surface of the thread 20 may be achieved by activating suitable nozzles arranged in between the first and the last nozzle. Other colouring effects may of course also be utilized. As the twist of the thread 20 is taken into account when determining the dispensing scheme, it is possible to control the resulting coating (or colouring) effect in a very accurate manner. This is due to the fact that as the thread 20 rotates at some point every circumferential position will be aligned with a nozzle 32*a-g*. Accordingly, a higher twist rate results in more twist per length unit of the thread 20 thus allowing for a more even and better coverage of the coating substance around the outer surface of the thread 20 as the nozzles to be activated may be chosen, or controlled, in accordance with a larger number of controlling schemes. Further to this, it will also be possible to reduce the entire length of the nozzle array 70 thus allowing for a more compact design of the system 10. How the thread 20 is coated around its circumference will among others depend on the droplet size. A small droplet size will result in a less coating coverage, which means that it may be required to dispense an increased number of droplets on the same longitudinal position of the thread 20 in order to obtain a full coverage around the circumference of the thread 20. In an embodiment, the control unit is configured to set the longitudinal distance d2 between the at least two activated nozzles 32*a-g* based on the twist per length unit ω [rad/m] of the thread 20, in accordance with $20\pi/\omega \geq d2 > 0$. This means that the calculated required longitudinal distance d2 is set to allow the thread to twist up to 10 revolutions between the two associated nozzles. In some embodiments the control unit 40 is further configured to set the longitudinal distance d2 between the nozzles to be activated based on the level of wetting of the thread. In alternative embodiments the control unit 40 is further configured to set the longitudinal distance d2 between the nozzles to be activated based on a pre-set colouring effect. The pre-set colouring effect may be selected from the group comprising homogeneous colouring pattern, one-side-only colouring pattern, random colouring pattern, or helical colouring pattern.

Further Embodiments

Figure 8:
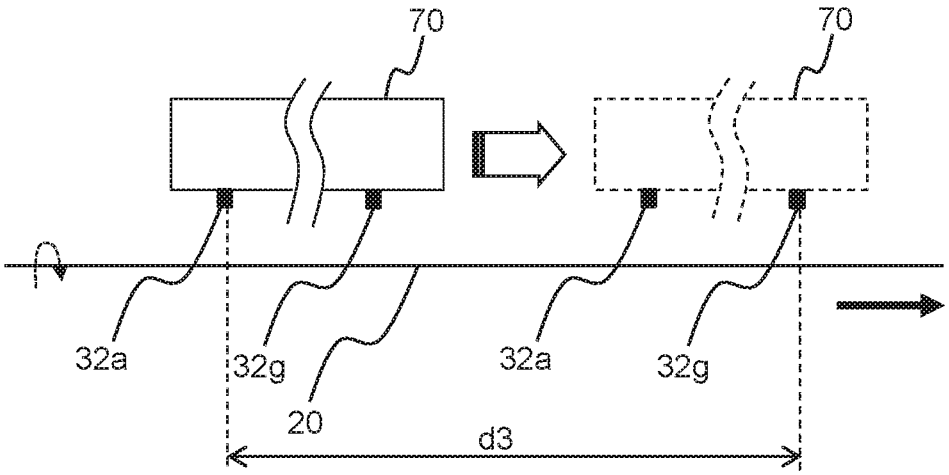
FIG. 8 shows a treatment unit according to an embodiment.
Figure 9:
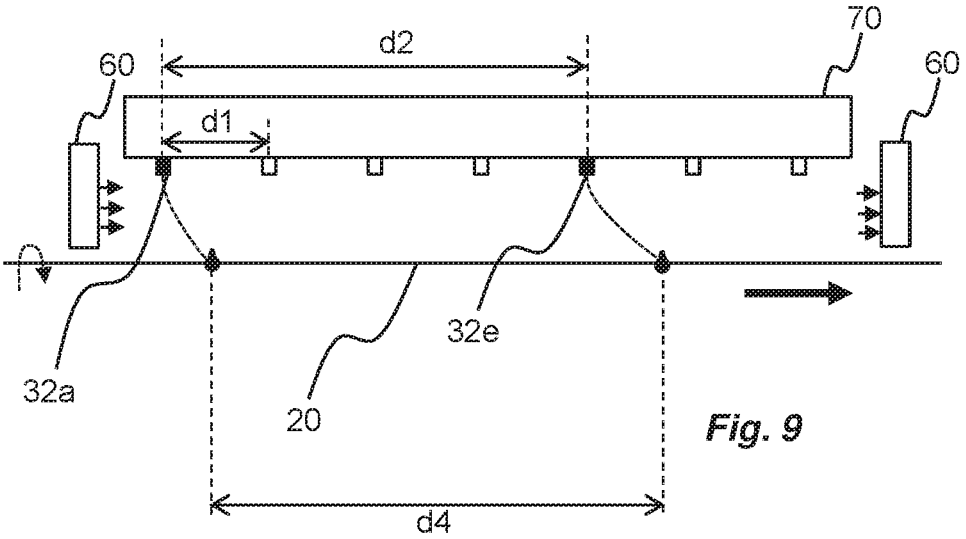
FIG. 9 shows a treatment unit according to an embodiment.

In a further embodiment, the treatment unit 30 comprises nozzles 32*a-g*, which may be separated by a longitudinal distance d3 that may be increased or decreased. Such embodiment is shown in FIG. 8. Now considering a situation where a first droplet is dispensed from a first nozzle 32*a*, and a subsequent droplet is dispensed from a second nozzle 32*g*. The longitudinal position of the secondly activated nozzle 32*g* may be adjusted, either by moving the secondly activated nozzle 32*g* relative the firstly activated nozzle 32*a*, or, as is shown in FIG. 8, by moving the entire nozzle array 70 after the first nozzle 32*a* has been activated, but before the activation of the second nozzle 32*g*. In another embodiment, the dispensed droplets could be diverted before they hit the thread 20 e.g. by applying an electromagnetic field. In such embodiment the control unit 40 is configured to set a longitudinal distance d4 between a first position at which a dispensed droplet from a first nozzle 32*a* is assumed to hit the thread 20 and a second position at which a subsequently dispensed droplet from a second nozzle 32*e* is assumed to hit the thread 20, and wherein the system 10 further comprises means 60 for changing the travel path of dispensed droplets in accordance with the longitudinal distance d4. This is shown in FIG. 9. This makes it possible to arrange the nozzles 32*a-g* at different positions along the longitudinal extension or direction of the thread 20 depending on a desired dispensing scheme. This is particularly advantageous when the calculated required longitudinal distance d4 for a certain desired dispensing scheme differs from what is physically possible, e.g. compared to what is obtained by calculating the longitudinal distance d2, d3 between the nozzles 32*a-g*. Should the distance d2, d3 differ from the required longitudinal distance, it would be possible to adjust the resulting dispensing scheme by diverting the droplets such that the resulting longitudinal distance d4 is matched with the desired longitudinal distance. For the embodiment described above utilizing a separation between nozzles 32*a-g*, at least one of the nozzles 32*a-g* is connected to a means, e.g. a motor (not illustrated), capable of adjusting the relative longitudinal distance d3 between the nozzles along and/or around the thread, or by changing the thread twist. The motor may receive input from the control unit 40. Depending on the twist of the thread 20, in conjunction with the speed thereof, the relative position between the nozzles 23*a-g* may be adjusted according to the associated dispensing scheme. Hence, the higher the level of twist as indicated by the twist level parameter of the thread 20, the closer the at least two nozzles 32*a-g* may be positioned to each other i.e. the longitudinal distance d3 may be decreased.

Analogously, a lower level of twist as indicated by the twist level parameter is translated to a larger relative distance between the nozzles 32*a-g* i.e. the longitudinal distance d3 is increased. Hence, by adjusting the longitudinal distance d3 between the at least two nozzles 32*a-g* it is possible to improve the coating quality of the thread 20, such that the coating substance is dispensed around the outer perimeter of the thread in a controlled manner. It should be noted that for a thread treatment unit 30 comprising more than two nozzles 32*a-g*, a motor may be connected to each additional nozzle such as to allow for adjustment of the longitudinal distance between each of the nozzles for example, the longitudinal distance between nozzle 32*c* and nozzle 32*d*. Due to the level of twist of the thread in conjunction with the adjusted longitudinal distance d3 between the at least two nozzles 32*a* and 32*b*, it is possible to fully cover the outer surface area, i.e. outer perimeter of the thread 20. This makes the treatment unit 30 much less complex than nozzles arranged at different radial positions around the thread 20.

Figure 10:
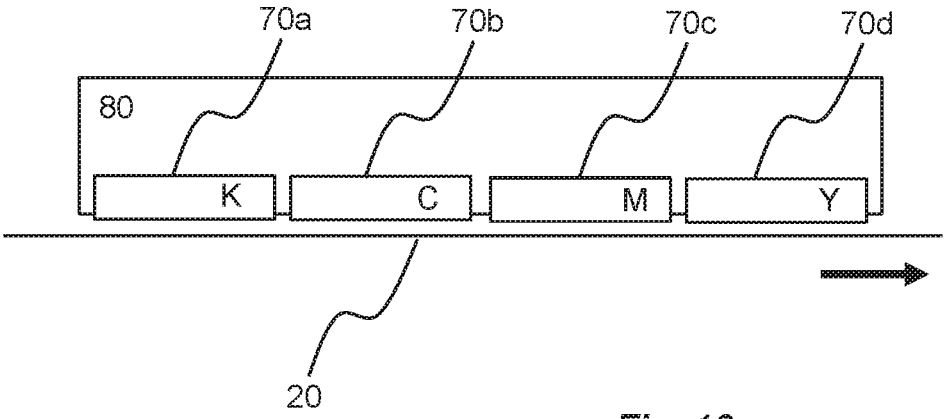
FIG. 10 shows a treatment unit according to an embodiment.

In an embodiment each nozzle dispenses a coating substance having a colour according to the CMYK colour model, where the primary colours are Cyan, Magenta, Yellow, and Black. It may thus be possible to dispense a wide variety of colours onto the thread by activating nozzles such that the total colouring substance will be a mix of the colouring substances dispensed by the nozzles. In FIG. 10 an embodiment is shown wherein a nozzle head 80 is provided with multiple nozzle arrays 70*a-d*. Each nozzle array 70*a-d* may for example be an inkjet nozzle array, comprising thousands of nozzles. As an example, each nozzle array 70*a-d* may be associated with a single colour, illustrated according to the CMYK standard. However, other colouring models may be used as well. It may also be possible to arrange the nozzle arrays 70*a-d* as separate units within the associated treatment unit (not shown). In another embodiment, each nozzle dispenses a coating substance having a colour comprising a mix of two or more primary colours of the CMYK colour model. In an embodiment, each nozzle is arranged within a nozzle plate (not illustrated), e.g. a flat nozzle plate, extending in a longitudinal direction in relation to the thread. From the above, it should be recognized that based on the level of twist of the thread, and the ability to either adjust the longitudinal distances between each of the nozzles or to identify any nozzles for activation based on this longitudinal distance, it is possible to optimize the dispensing pattern formed by the included nozzles such that the best possible and most desired thread coating quality is achieved.

Figure 11:
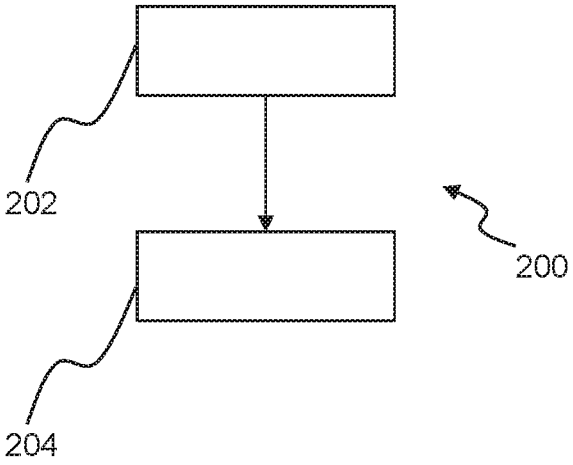
FIG. 11 is a schematic view of a method of providing treatment to at least one thread according to an embodiment.

Now turning to FIG. 11 a method 200 for providing in-line treatment of at least one thread will be described. The method 200, being performed for providing treatment to at least one thread prior to being fed to a thread consuming unit, comprises a first step 202 of feeding the at least one thread in a downstream direction towards the thread consuming unit such that it engages with at least one thread engagement device whereby the at least one thread causes to rotate along its longitudinal axis. Feeding of the thread 20 may e.g. be performed by pulling the thread 20. The method 200 also comprises a step 204 of passing the at least one thread through a treatment unit having a plurality of nozzles arranged at different positions relative the at least one thread. The treatment unit is optionally arranged upstream the thread engagement device such that the rotation of the thread is occurring as the at least one thread is passing the treatment unit. Each nozzle is further configured to dispense one or more coating substances onto the at least one thread when activated, such that the thread may be treated (or coloured) in a customized manner due to the rotation of the thread.

Although the present invention has been described above with reference to specific embodiments, it is not intended to be limited to the specific form set forth herein. Rather, the invention is limited only by the accompanying claims.

In the claims, the term "comprises/comprising" does not exclude the presence of other elements or steps. Additionally, although individual features may be included in different claims, these may possibly advantageously be combined, and the inclusion in different claims does not imply that a combination of features is not feasible and/or advantageous. In addition, singular references do not exclude a plurality. The terms "a", "an", "first", "second" etc do not preclude a plurality. Reference signs in the claims are provided merely as a clarifying example and shall not be construed as limiting the scope of the claims in any way.

What is claimed is:

1. A system for in-line treatment of at least one thread for use with a thread consuming device, comprising:

a treatment unit having a plurality of inkjet nozzles arranged at different positions relative the at least one thread, said at least one thread being in motion in use, each inkjet nozzle being configured to dispense one or more coating substances onto the at least one thread when activated; and at least one thread engagement device, wherein the at least one thread engagement device is a static guiding member comprising an engagement surface, wherein the at least one thread engagement device is configured to:

apply a torque to said at least one thread in order to initiate a rotation of the at least one thread, and wherein the engagement surface which, when in contact with said at least one thread, provides a rotation of said at least one thread along its longitudinal axis as the at least one thread moves through said treatment unit.

2. The system according to claim 1, wherein one of said at least one thread engagement devices is arranged on a downstream side of the treatment unit along the travel direction of the at least one thread.

3. The system according to claim 1, wherein one of said at least one thread engagement device is moveable in order to control the rotation of the at least one thread along its longitudinal axis.

4. The system according to claim 1, wherein the at least one thread engagement devices comprises at least two thread engagement devices, wherein one of said thread engagement devices is one or more tubular through which the at least one thread is guided.

5. The system according to claim 4, wherein one tubular member is arranged on a downstream side of said treatment unit, and/or one tubular member is arranged on an upstream side of said treatment unit.

6. The system according to claim 4, wherein the inner diameter of said tubular member is selected such that the inner walls of said tubular member will apply a friction force to said at least one thread.

7. The system according to claim 4, wherein said tubular member is rotatable along its longitudinal axis.

8. The system according to claim 1, wherein said at least one thread engagement device comprises a rotating engagement member having an outer surface on which the at least one thread is guided for providing a rotation.

9. The system according to claim 1, further comprising at least one thread guiding member arranged downstream and/or upstream the at least one thread engagement device.

10. The system according to claim 1, wherein the coating substance is a colouring substance.

* * * * *